United States Patent [19]

Kessler

[11] 4,026,446

[45] May 31, 1977

[54] CLOTHES HANGER

[76] Inventor: Milton Kessler, c/o Kessler Products Co., Inc., 302 McClurg Road at Southern Blvd., Youngstown, Ohio 44501

[22] Filed: June 28, 1976

[21] Appl. No.: 700,567

[52] U.S. Cl. ..... 223/88

[51] Int. Cl.[2] ..... A47J 51/094

[58] Field of Search ..... 223/88, 98; 211/113, 211/123; 16/110 R, 116 R, 111 R, 111 A, DIG. 12

[56] References Cited

UNITED STATES PATENTS

| | | | |
|---|---|---|---|
| 2,052,606 | 9/1936 | Comstock | 211/123 |
| 2,160,127 | 5/1939 | Coney | 223/88 |
| 2,252,054 | 8/1941 | Welch | 16/DIG. 12 |
| 2,655,296 | 10/1953 | Winzer | 223/88 |
| 2,710,124 | 6/1955 | Laumeyer | 223/88 |
| 3,189,069 | 6/1965 | Stowell | 16/116 R |
| 3,225,980 | 12/1965 | Wieckmann | 223/88 X |

*Primary Examiner*—George H. Krizmanich
*Attorney, Agent, or Firm*—Meyer, Tilberry & Body

[57] ABSTRACT

A wire clothes hanger is provided in which the horizontal rung is provided with an encircling serrated sleeve adapted to grip garments draped thereover. To prevent the sleeve from slipping about the horizontal rung the sleeve and horizontal rung are provided with positive interlocking means.

4 Claims, 13 Drawing Figures

CLOTHES HANGER

THE PRIOR ART

That garments are notoriously difficult to retain in place on standard wire type clothes hanger horizontal rungs is a matter of common experience. That prior art garment gripping means used in association with wire type coat hanger horizontal rungs are generally unsatisfactory is also a matter of common knowledge. Wire clothes hangers are presently known wherein various friction devices comprise or are affixed to the horizontal rungs such as abrasive coatings, adhesive treated paper tubes, rubber pads, and the like. In one prior art clothes hanger embodiment the horizontal rung is wrapped with double coated adhesive tape about which is affixed an extruded tube slit longitudinally to be received over the horizontal rung. The double coated adhesive tape is intended to bond with the interior of the tube to prevent the tube from slipping. This embodiment is expensive to make because the adhesive tape must be applied to the hanger by hand. It has also been observed that the adhesive reacts with certain plastics, such as polyvinyl chlorides, which destroy the effectiveness of the adhesives.

THE OBJECTS OF THE INVENTION

It is therefore among the objects of the subject invention to provide an improved clothes hanger that is inexpensive to make, that may be mass produced with a minimum of hand labor, that employs a garment holding horizontal rung comprising a plastic extruded sleeve made of polyvinyl chloride or a similar such plastic; that employs a horizontal rung encased in a plastic extruded sleeve wherein the sleeve and the rung are interlocked with mating configurations to prevent relative rotational movement therebetween.

These and other objects and advantages will become apparent from the following description taken together with the accompanying drawings in which.

Figure 1:
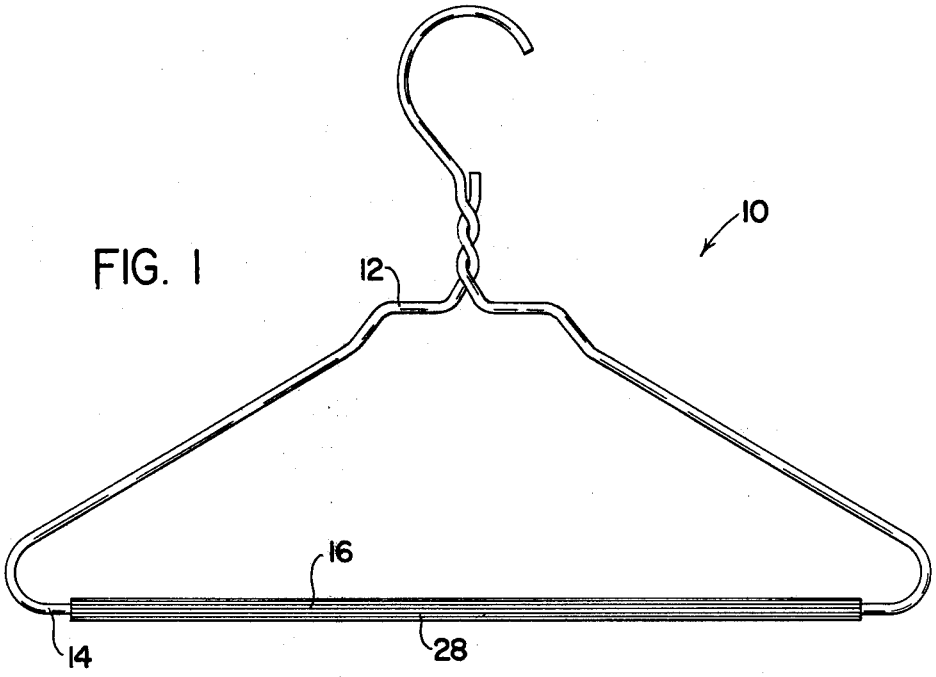
FIG. 1 is an elevational view of a preferred embodiment of the invention.

Referring now to the drawings in greater detail, the invention as shown in FIG. 1 comprises a clothes hanger preferably, although not necessarily, formed from a single piece of wire 12 by means well understood by those skilled in the art. A horizontal cross member or rung 14 may have any of several cross-sections, each of which is adapted to coact with the matching interior of a sleeve 16. The sleeve 16 may be extruded in the C-shape shown in FIG. 2, or in the alternative it may be extruded in tubular form and then slit along a longitudinal axis of the extrusion. Polyvinyl chloride and similar plastics, as well as rubber, have been used successfully for this purpose. Essentially, the sleeve must be flexible enough to receive the rung 14, but sufficiently rigid so as not to be easily removed from the rung.

Figure 2:
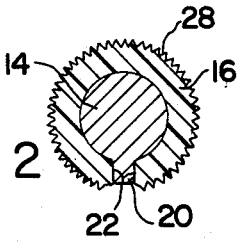
FIGS. 2 through 7 are cross-sectional views of preferred embodiments of the horizontal rung member of a clothes hanger shown in FIG. 1.
Figure 3:
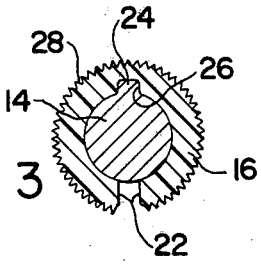
Figure 4:
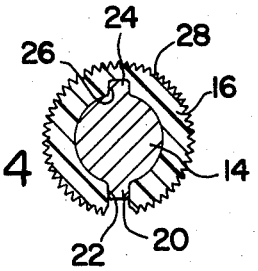
Figure 5:
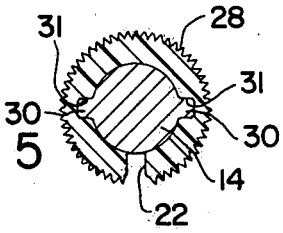
Figure 6:
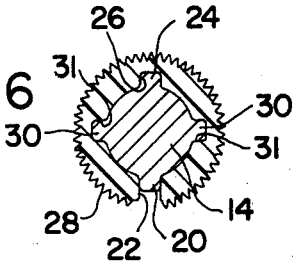

In like manner, the hanger wire 12 may be extruded or the horizontal rung roll formed to any of the cross-sectional shapes shown in FIGS. 2 through 7 and 13. Also, the rung 14 may be formed separately such as by spot forming detents 18 shown in FIGS. 8 through 11. For instance, as shown in FIG. 2, the rung 14 is provided with a rib 20 on its underside along which the edges 22 of sleeve 16 abut. In FIG. 3, the rib 24 of rung member 14 is on the upper side and is received within a matching groove 26 of sleeve 16. The exterior surface of the sleeve 16 may be longitudinally fluted or, as shown in the Figures, provided with discreet serrations 28. Other irregular surfaces, such as hobs and indentations on the sleeve 16 sufficient to provide garment retention are also within the contemplation of the invention.

Figure 7:
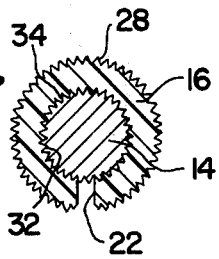
Figure 8:
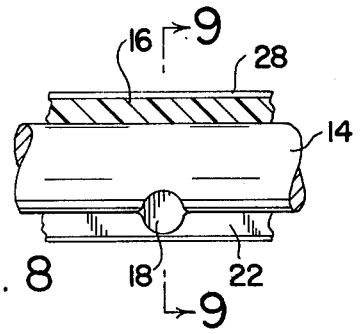
FIG. 8 is a fragmentary view partially in section of another preferred embodiment of the invention.
Figure 9:
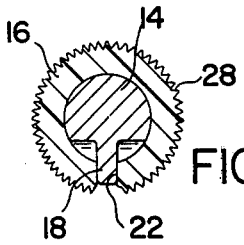
FIG. 9 is a cross-sectional view taken along the line 9—9 of FIG. 8.
Figure 10:
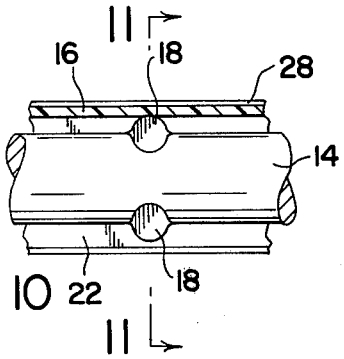
FIG. 10 is a fragmentary view partially in section of yet another preferred embodiment of the invention.
Figure 11:
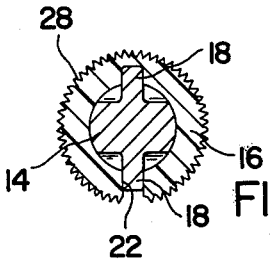
FIG. 11 is a cross-sectional view taken along the line 11—11 of FIG. 10.

Any number of ribs 20, 24 and 30 and grooves 26 and 31 may be utilized as shown in FIGS. 2 through 6. In FIG. 7 both the exterior surface 32 of rung 14 and the interior surface of sleeve 16 are provided with interlocking serrations.

Figure 12:
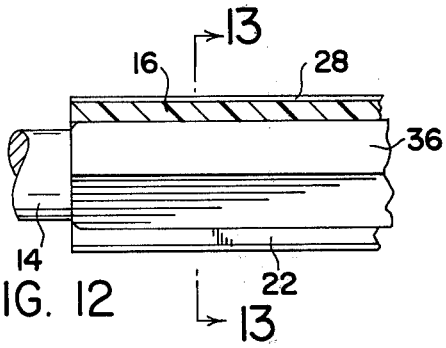
FIG. 12 is a fragmentary view partially in section of still another preferred embodiment of the invention; and, FIG. 13 is a cross-sectional view taken along the line 13—13 of FIG. 12.
Figure 13:
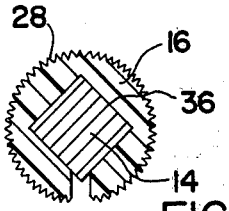

In lieu of ribs, detents or serrations the surface of rung 14 may be provided with one or more flats, as shown in FIGS. 12 and 13.

The foregoing examples of preferred embodiments of the invention are illustrative of various means within the scope of the disclosed concept for providing a clothes hanger which may be cheaply mass produced with high production tools to provide a durable and reliable cross member for draping garments such as trousers, skirts, towels, ties, and the like.

Other equivalent embodiments will occur to those skilled in the art upon a reading of this disclosure and such embodiments are contemplated within the scope of this invention as set forth in the appended claims.

What is claimed is:

1. In a one piece round wire clothes hanger with a straight horizontal rung for draping garments thereover, a slit sleeve adapted to encircle said horizontal rung and detent means formed on said rung to prevent rotation of said sleeve on said rung, the improvement comprising: a flat parallel sided rib extending along the underside of said horizontal rung; said slit sleeve having edges which are flat and spaced apart the width of said flat sided rib to make surface to surface contact with the straight flat sides of said rib, the outer surface of said slit sleeve being uniformly serrated with longitudinally extending circumferentially arrayed sawteeth; and the interior surface of said sleeve being round and having an interior diameter substantially equal to the outside diameter of said horizontal rung.

2. The clothes hanger set forth in claim 1, wherein said flat sided rib extends horizontally along the underside of said horizontal rung.

3. The clothes hanger set forth in claim 1, wherein said flat sided rib is pressed from opposite sides of the underside of said horizontal rung to form a flat localized protrusion projecting downwardly therefrom.

4. The clothes hanger set forth in claim 3, including at least one additional flat sided rib pressed from opposite sides of the underside of said horizontal rung to form a localized protrusion projecting downwardly therefrom, said ribs being spaced sufficiently apart to stablize said sleeve on said horizontal rung.

* * * * *